US005316212A

United States Patent [19]

Eriksson et al.

[11] Patent Number: 5,316,212

[45] Date of Patent: May 31, 1994

[54] PACKAGE AND BLANK FOR MAKING THE SAME

[76] Inventors: Per A. Eriksson, Solbacksvägen 6, S-217 63 Malmö ; Mats A. Lindgren, Björkgatan 22, S-214 34 Malmö , both of Sweden

[21] Appl. No.: 997,178

[22] Filed: Dec. 28, 1992

[30] Foreign Application Priority Data

Dec. 30, 1991 [SE] Sweden ..... 9200007-4

[51] Int. Cl.[5] ..... B65D 5/54; B65D 5/72

[52] U.S. Cl. ..... 229/215; 229/125.42

[58] Field of Search ..... 229/214, 215, 217, 219, 229/125.42

[56] References Cited

U.S. PATENT DOCUMENTS

| | | | |
|---|---|---|---|
| 1,539,985 | 6/1925 | Allen | 229/215 |
| 1,837,749 | 12/1931 | Becker | 229/219 |
| 1,907,939 | 5/1933 | Venning et al. . | |
| 2,029,747 | 2/1936 | Venning et al. | 229/215 |
| 2,323,447 | 7/1943 | Chase | 229/125.42 |
| 2,341,397 | 2/1944 | Smith | 229/217 |
| 2,488,323 | 11/1949 | Parker | 229/125.42 |
| 2,634,897 | 4/1953 | Bord . | |
| 3,017,065 | 1/1962 | Collie | 229/125.42 |
| 3,085,733 | 4/1963 | Umanoff | 229/219 |
| 3,184,137 | 5/1965 | Mohler . | |
| 3,204,250 | 8/1965 | Poole et al. . | |
| 3,344,972 | 10/1967 | Robinson et al. | 229/215 |
| 3,568,910 | 3/1971 | McConnell | 229/125.42 |
| 4,111,351 | 9/1978 | Mackiernan . | |
| 4,194,677 | 3/1980 | Wysocki . | |
| 4,569,443 | 2/1986 | Roccaforte | 229/215 |

FOREIGN PATENT DOCUMENTS

| | | | |
|---|---|---|---|
| 70420 | 11/1987 | Australia . | |
| 546884 | 10/1957 | Canada | 229/214 |
| 92953 | 5/1962 | Denmark . | |
| 1491317 | 8/1967 | France | 229/219 |
| 1575572 | 7/1969 | France | 229/125.42 |
| 2032129 | 11/1970 | France . | |
| 329299 | 9/1936 | Italy | 229/125.42 |
| 2030964 | 4/1980 | United Kingdom | 229/219 |
| 2215308 | 9/1989 | United Kingdom | 229/125.42 |

*Primary Examiner*—Gary E. Elkins

*Attorney, Agent, or Firm*—Luedeka, Hodges, Neely & Graham

[57] ABSTRACT

A package having cardboard wall panels and a retractable pour spout (40) is fabricated from an integral cardboard blank with a respective pair of overlapping inner and outer wall panels (10 and 14) whereby the package is opened for content removal by extending said pour spout (40).

40 Claims, 3 Drawing Sheets

PACKAGE AND BLANK FOR MAKING THE SAME

Figure 1:
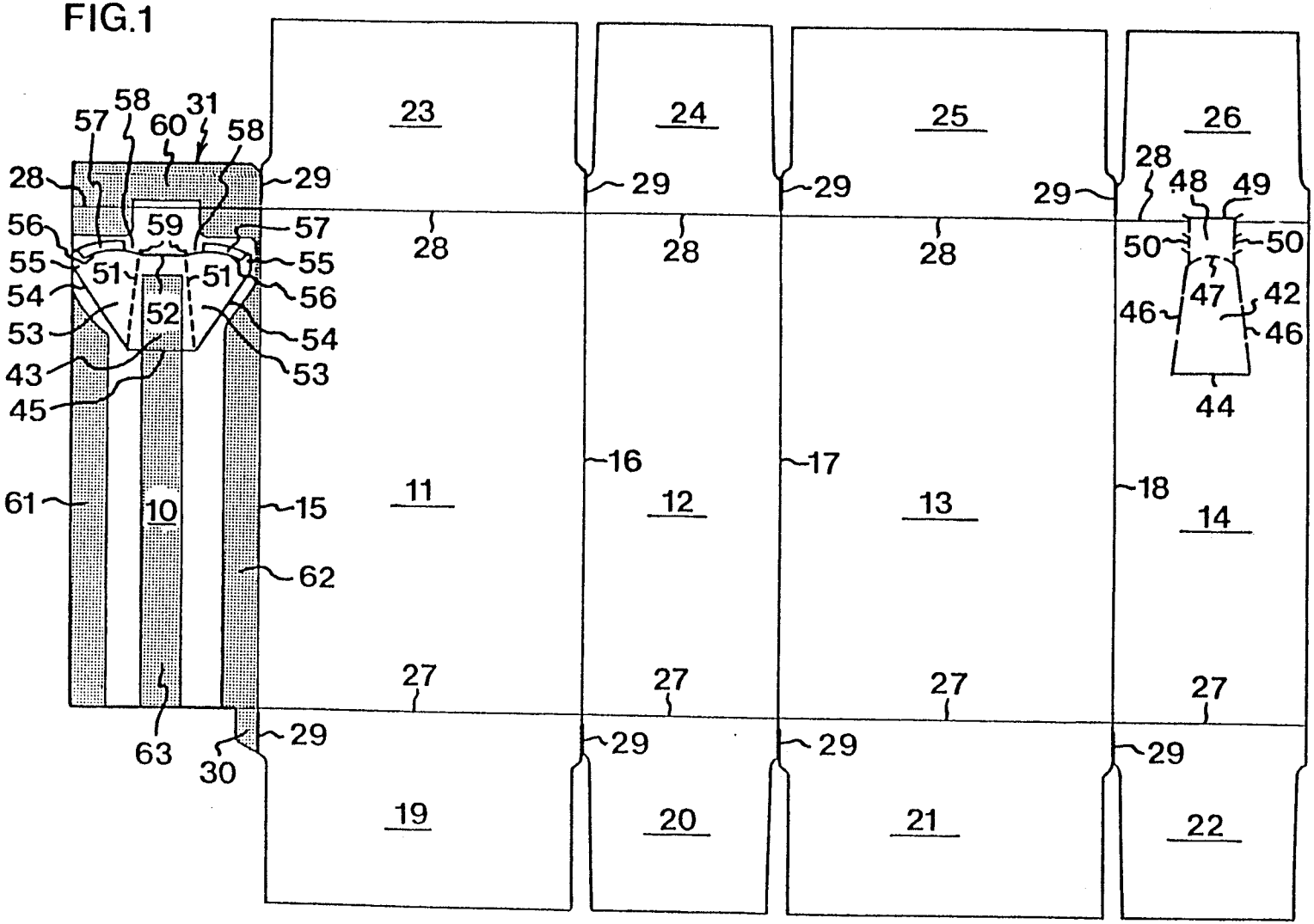

The present invention relates to a package made of cardboard material and having an openable and closable spout, as well as a blank for making such a package.

It is well-known to provide packages with a separately-made spout of metal material, in which case the spout is mostly covered by a glued covering paper in the unopened package. This prior-art construction suffers from several drawbacks, inter alia that the covering paper has to be removed or cut up before the package is opened for the first time. Also, recycling the package for environmental reasons is no easy procedure, since the metal part first has to be separated from the paper part. In addition, the making of the package is complicated by the necessity of supplementing the blank with the spout during the manufacture of the package.

However, the prior art also encompasses packages in which the spout is formed from the cardboard material itself. Such packages and blanks are disclosed e.g. in U.S. Pat. Nos. 2,634,897, 3,184,137, 3,204,250, 4,111,351 and 4,194,677. Also these prior-art packages and blanks are impaired by several drawbacks. Thus, some of the packages are not especially well suited for holding free-flowing pulverulent or granular materials, such as salt, sugar, flour and fine washing powder, in which case the unopened package has to have an especially high tightness. Some of these prior-art packages further require that spout components be so punched in the blank that the latter is weakened or that it becomes very difficult to erect the finished package while maintaining a precise fit between the various spout components.

U.S. Pat. No. 2,634,897 thus discloses a package and a blank. In one embodiment, punching is performed in three different panels, which are then glued in overlapping relationship when the package is erected. In another embodiment, punching is performed in two end-wall panels glued in overlapping relationship. In both cases, the spout is so designed that the contents of the package may escape between the punched-out parts of the inner spout component and the punched-out side edges of the outer spout component. Another drawback of this prior-art construction resides in the large width of the spout components. As a result, the spout must, when formed in but two end-wall panels glued in overlapping relationship, be so oriented that the package has to be held in a laid-down position when the packaged goods is poured out. The need of orienting the package in this way heavily restricts the utility of the package and renders it unsuitable for e.g. salt or sugar.

U.S. Pat. No. 3,184,137 discloses a package and a blank for making the package. In this case, the spout is designed as an extension piece of an adhesive bonding flap used for gluing the blank to a sleeve. This construction not only involves a lower degree of utilisation of the cardboard material, but also makes it extremely difficult to erect the package, since this requires the use of a special machine for folding, in a preparatory step, the extension piece so as to place it in an overlapping position relative to the remainder of the package blank. In addition, the construction is such that pulverulent or granular goods may escape through punched-out portions of the spout components when the package is unopened.

U.S. Pat. No. 3,204,250 also discloses a package and a blank, in which the spout is formed of components from three panels glued in overlapping relationship. As mentioned before, this entails higher requirements on fit when the package is erected. Also in this case, the unopened package is liable to leak pulverulent or granular goods at the punched-out end of the spout.

U.S. Pat. No. 4,111,351 discloses a package and a blank, in which a separate spout is provided on the inside of a side wall panel. The spout is designed to dose a predetermined amount of goods on each occasion of discharge, but may also be designed for continuous discharge of the goods. Although this construction provides a tight unopened package, it requires an additional component which has to be separately mounted in the making of the package.

U.S. Pat. No. 4,194,677 discloses a package and a blank, in which the spout components are formed in two side wall panels glued in overlapping relationship and in which the spout channel side walls are designed so as to restrict the outward movement of the spout. However, this prior-art spout construction suffers from several drawbacks. Thus, an adhesion-counteracting material has to be applied round the inner component of the spout, which makes the unopened package untight, since there may be a leakage between the end edges of the inner and the outer spout components placed at a short distance from one another. Further, the spout side walls are insufficiently guided in the lateral direction and may thus come to move towards one another under the action of the packaged goods when the spout is moved inwards. As a result, there may be a leakage beside the spout when this has been used a great number of times.

FR-A-2,032,129 discloses a package and a blank, in which one of the spout components is formed in a side wall panel and the other spout component is formed in an additional flap which is glued in overlapping relationship to the side wall panel. The components formed in the additional flap comprise two spout side walls delimited from surrounding parts of the additional flap by an arcuate punched line and merging into hook-forming punched lines. In the erected and closed package, these spout side walls are free of adhesive bond to adjoining parts of the outer side wall panel. However, this prior-art package is impaired by several inconveniences, the most important being the fact that the opened package is untight after the spout has been closed. This is due to the formation of a through hole when the spout it pulled out and deformed to form the pouring lip of the spout. By this design of the spout device, the spout side walls may easily come to bend inwards in use, with the result that the pulverulent or granular goods may, when poured out, escape beside the spout. Another inconvenience is that it may be difficult to pull out the spout when opening the package for the first time, owing to the design of the spout side walls and the adjoining material in the additional flap.

DK-B-92953 discloses a package which has a spout formed in an inner side wall panel and disposed behind an H-shaped weakened area which, when the package is opened, is broken and pressed in, thereby making it possible to reach the spout in the inner side wall panel with the fingers. This prior-art package suffers from the drawback that it is difficult to pull out the spout, so that it is often necessary to use a tool, such as a knife, for opening the package. Since the material of the outer side wall panel has to be pressed inwardly to give access to the spout, the function of the spout is impaired and the aesthetical appearance suffers.

AU-B-70420/87 also discloses a package in which a spout has been formed. The illustrated packages are designed so as to be tight when unopened owing to the spout being then covered by a tear flap in the outer side wall panel, but they are nevertheless untight when reclosed. In addition, the bottom of the spout is not double, and the spout therefore becomes weak and easily deformed and thus will function in unsatisfactory manner when used for a long time and repeatedly opened and closed.

U.S. Pat. No. 1,907,939 discloses a blank and a package, in which a spout device is formed in an inner side wall panel and a flap construction, which can be pressed in and torn off, is punched in the outer side wall panel opposite to the spout device. When unopened, this package is not completely tight, thereby making it possible to tamper with the contents of the package through narrow openings existing at the flap construction and the spout inwardly thereof. When opened, the reclosable package is rather untight, and the spout, whose bottom is made of but one layer of material, is weak.

One object of the present invention is to obviate or substantially reduce the drawbacks of the prior-art packages and blanks.

Another object of the present invention is to provide a standard package of cardboard or similar material and a blank therefor, which includes a pouring spout formed without the use of metal material.

A further object is to produce such a package and a blank in which the spout is formed of two overlapping panels and still is extremely tight in unopened, as well as opened and reclosed, position of the spout.

According to the invention, these and other objects are achieved by a package and a blank designed in accordance with appended the particularly preferred embodiments of the invention.

When making a package according to the invention, the blank is formed of cardboard material or similar sheet material. A spout is formed from the cardboard material itself in an at least partially double-walled side wall comprising inner and outer side wall panels glued together. The spout channel bottom is formed of outer and inner layers which are adhesively bonded or glued together in overlapping relationship in the erected package. Substantially triangular spout channel side walls are formed in the inner side wall panel. The channel side walls are delimited from the inner layer of the channel bottom by fold lines or perforated lines and delimited from the remainder of the inner side wall panel by punched lines. At the outer end of the spout channel bottom, the inner layer of the channel bottom is delimited from the remainder of the inner side wall panel by a punched line. In the erected package, the channel side walls are free of adhesive bond to adjoining parts of the outer side wall panel. The outer layer of the spout channel bottom is delimited from the remainder of the outer side wall panel by perforated lines. According to the invention, the outer side wall panel has a tear flap between the outer end of the outer layer of the channel bottom and an edge of the side wall panel situated at a distance therefrom. At this edge, the tear flap is delimited by a punched line, and the other edges of the tear flap are formed of perforated tear lines. At the most, there is a weak adhesive bond between the tear flap and juxtaposed parts of the inner side wall panel. The end edges of the channel side walls are formed of arcuate punched lines so designed that, when the spout is opened and closed, they come into guiding engagement with short punched lines which, from the outer end of the inner layer of the channel bottom, extend outwards in the inner side wall layer.

The invention will be described in more detail below with reference to the accompanying drawings illustrating two embodiments of a package and a blank according to the invention. In the drawings, FIG. 1 is a view of an unfolded blank, FIG. 2 is a perspective view of an unopened package formed from the blank, FIG. 3 is a perspective view of an opened package formed from the blank, and FIG. 4 shows parts of a blank for another embodiment of the invention.

Figure 3:
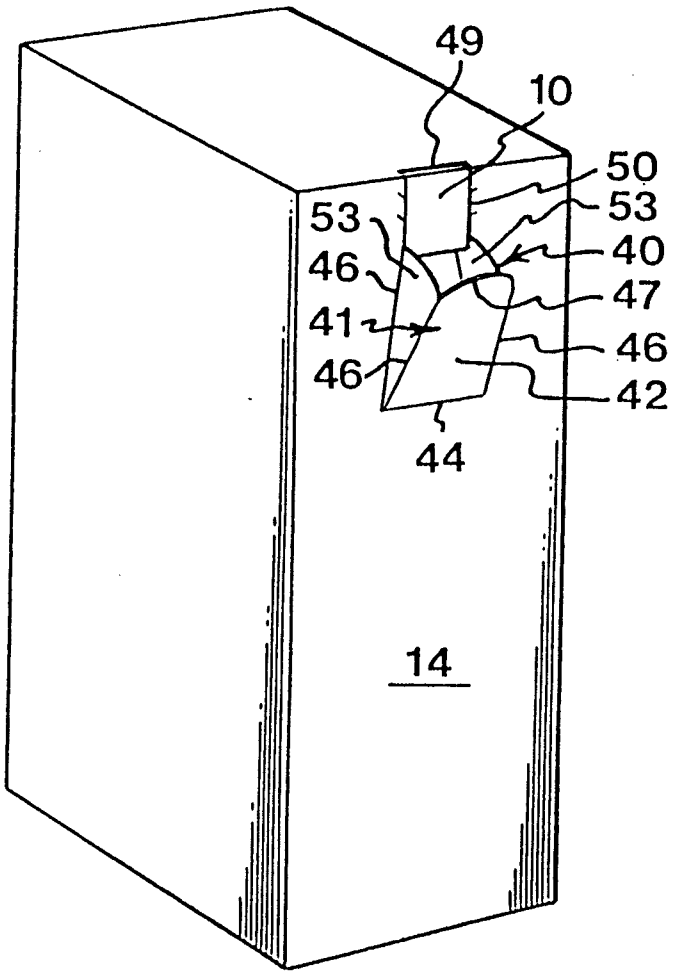
Figure 2:
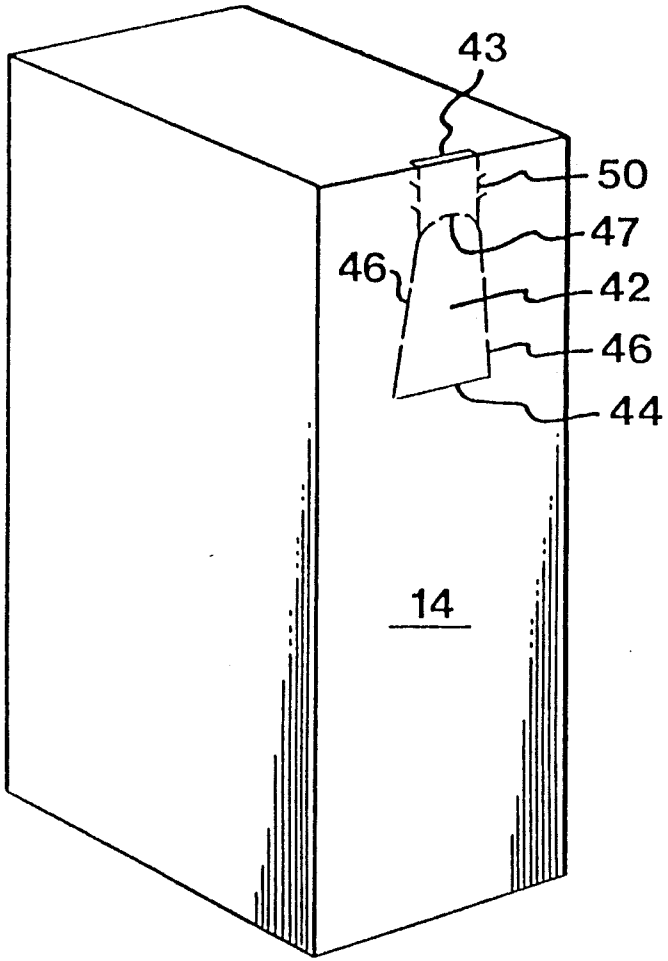
Figure 4:
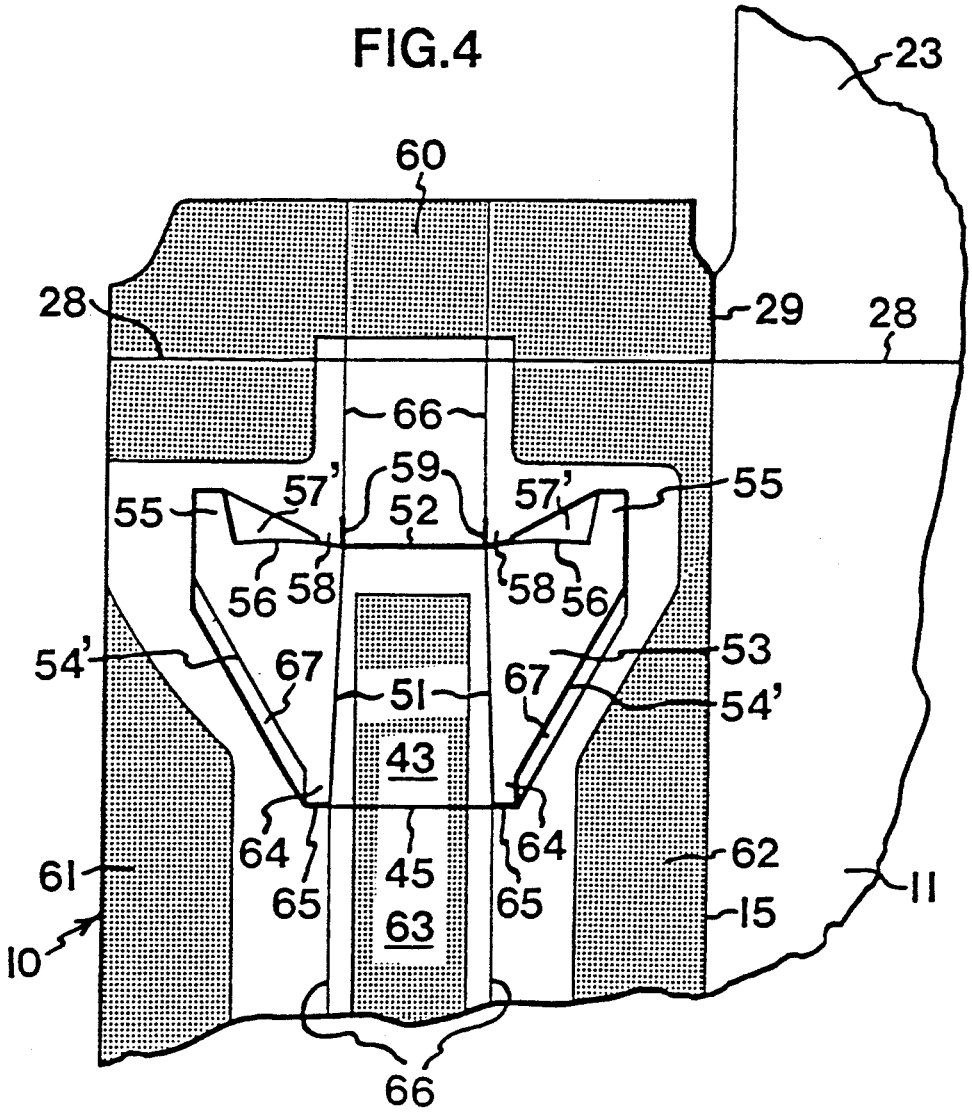

The embodiment of a package and a blank according to the invention shown in FIGS. 1–3 is intended for the packaging of pulverulent or granular material, such as salt and sugar for domestic use. Conveniently, the package is made of solid board or single-wall corrugated fibreboard in E-flute design. Also other sheet materials may be used.

As appears from FIG. 1, the blank comprises five side wall panels 10–15 which are interconnected by fold lines 15–18. The side wall panels 10 and 14 are intended to be glued or adhesively bonded together in overlapping relationship when the package is erected. In the embodiment shown, the side wall panel 10 is of essentially the same size as the side wall panel 14, even though it mostly resembles an adhesive bonding flap for gluing the panels 10–14 to a sleeve.

The blank also comprises bottom- and lid-forming panels 19–22 and 23–26, respectively, which are connected to adjoining panels by fold lines 27 and 28, respectively. The panels 19–22 and 23–26 are separated from one another by punched lines. When the package is to be extremely tight, the punched lines 29 between the different panels terminate just outwardly of the adjoining fold lines 27, 28, in which case the fold lines 15–18 are extended beyond these lines up to where the punched lines 29 start. In addition to the panels 19–26, there is provided an adhesive bonding flap 30 at the bottom end of the side wall panel 10. The flap 30 is connected to the side wall panel 10 by the fold line 27, but is separated from the flap 19 by the punched line 29. Similarly, an adhesive bonding flap 31 is provided at the lid end of the side wall panel 10. The flap 31 is connected to the side wall panel 10 by the fold line 28 and is separated from the flap 23 by the punched line 29.

Actually, it is known to design a blank in this manner so as to obtain a high degree of tightness in the package corners.

The package according to the invention comprises a pouring spout 40 formed from the cardboard material as such. This spout is made from material in the two side wall panels 10 and 14 which are glued or adhesively bonded together in overlapping relationship. Further, the spout has a two-layer channel bottom 41 formed of an outer channel bottom layer 42 and an inner channel bottom layer 43. The outer channel bottom layer 42 is delimited from the remainder of the outer side wall panel by a fold line 44 provided at the inner end of the spout and serving as a hinge. Similarly, the inner channel bottom layer 43 is delimited from the remainder of the inner side wall panel 10 by a fold line 45 provided at the inner end of the spout and serving as a hinge. The two fold lines 44, 45 are situated substantially opposite to one another in the erected package. Preferably, the fold lines 44 and 45 are located at a distance from each other corresponding to the thickness of the cardboard material, the fold line 44 being closer to the bottom of the package than is the fold line 45, thus taking into consideration the radius of curvature of the cardboard material during the opening and closure of the spout.

The side edges of the outer layer 42 of the spout channel bottom are delimited from the remainder of the outer side wall panel 14 by substantially straight perforated lines 46 which, at the outer end of the spout, merge into an outwardly-curved arcuate perforated line 47. As will be explained in more detail below, the perforated line 47 will form the edge of the gripping flap for operating the spout when the package has been opened.

According to the invention, there is provided a tear flap 48 between the outer layer 42 of the spout channel bottom and the adjoining edge (the fold line 28) of the outer side wall panel 14. This tear flap is delimited by a punched line 49 and two perforated tear lines 50 extending from the punched line 49 approximately to the ends of the arcuate perforated line 47. In the erected package, there is no adhesive bond between the tear flap 48 and adjoining parts of the side wall panel 10. Optionally (but currently not preferred), a weak adhesive bond may be present between the tear flap 48 and the side wall panel 10. However, such a weak adhesive bond must not make it more difficult to remove the tear flap when opening the package.

As appears from FIG. 1, the punched line 49 is situated slightly outwardly of the fold line 28. Such an arrangement is preferred, since the edge of the tear flap 48 formed by the punched line 49 thus becomes much more accessible when opening the package for the first time. If one so desires, the punched line 49 may be located in the fold line 28 itself.

It is also evident from FIG. 1 that the inner layer 43 of the spout channel bottom is laterally delimited by two substantially straight perforated lines 51. These lines may, however, be replaced with fold lines, but this is not equally preferred at present. At the outer end of the spout, the inner layer 43 is delimited by a punched line 52 which is located at a shorter distance from the fold line 45 than is the arcuate perforated line 47. Thus, the outer layer 42 will project beyond the perforated line 52, thus forming a gripping flap for operating the spout and providing a certain sealing effect in the opened package when the spout 40 is in its closed position.

The substantially triangular side walls 53 of the spout are punched in the inner side wall panel 10 by essentially straight punched lines 54 extending from the ends of the fold line 45 and merging, at the outer end, into a punched line forming small hooks 55. Arcuate punched lines 56 extend between the hooks and the fold lines or perforated lines 51. Outwardly of the arcuate punched lines 56, there are provided punched holes 57 which do not have the same length as the punched lines 56 but leave flaps 58. The purpose of the punched holes 57 in the inner side wall flap 10 is to make it easier to pull the spout side walls 53 towards one another when the spout is pulled out for the first time when the package is opened. Thus, the holes 57 leave space for the lateral movement of the hooks 55 during the first stages of the outward pulling procedure, before the spout side walls 53 have been swung a certain angle about the fold lines or perforated lines 51.

Further, short punched lines 59 are provided outwardly of the fold lines or perforated lines 51, approximately at the ends of the punched line 52. In addition, the arcuate punched lines 56 are so designed that the resulting end edges of the spout side walls 53 will, when the spout is moved outwards, engage with the short punched lines 59 and be positively guided by these lines, such that the spout 40 will maintain its channel shape better than without this engagement. Thus, the punched lines 59 considerably reduce the risk of the spout side walls being turned downwards-inwards towards the spout channel bottom.

In FIG. 1, the dotted portions are the adhesive areas 60, 61, 62 and 63 where the inner side wall panel 10 is glued to the outer side wall panel 14. It appears from the design of the adhesive areas that no gluing takes place between the tear flap 48 and the corresponding portions of the inner side wall panel 10. It is further evident that the adhesive area 63 joins the inner and outer layers 42 and 43, respectively, of the spout bottom 41 to one another. Also, essentially the entire adhesive bonding flap 31 is glued to the inside of the lid flap 26. Such design and gluing of the flap 31 results in a high rigidity of the edge portion where the tear flap 48 is situated. This additional rigidity is achieved by the fold line 28 of the flap 31 being unbroken along the entire flap 31, thus bridging the interruption caused by the tear flap 48 in the fold line between the side wall panel 14 and the lid flap 26. This rigidity also helps to further reduce the risk of leakage via the punched line 52 and between the tear flap 48 and the inner side wall panel 10 and via the punched line 49. If even higher tightness is desired, a weak glue may optionally be used in this area, but this glue then must not be so strong that it prevents, or unduly obstructs, the removal of the tear flap 48, thereby making it too difficult for the user to open the package for the first time.

FIG. 4 illustrates another embodiment of the invention. Here, the same reference numbers as in FIG. 1 serve to designate equivalent parts. Also, only those parts of the blank that differ from the blank in FIG. 1 are shown. Thus, the spout outer layer formed by the outer side wall panel is designed as in FIG. 1 (the flap 14). In this embodiment, the holes 57' are slightly different, but still leave space for the movements of the hooks 55 when the spout is pulled out when the package is opened for the first time. Further, holes 67 are here punched in the inner side wall panel 10 also at the sides of the side walls 53 of the spout. However, this is by no means compulsory.

Another difference improving the function of the spout resides in the fact that those punched lines 54' that extend downwards from the hooks 55 towards the intersection of the fold line 45 and the fold lines 51, are not straight, but leave a small piece of material 64 between the fold lines 51 and the punched lines 54'. Simultaneously, the fold line 45 is extended outwards in both directions by a punched line 65. However, the perforated tear lines which correspond to the punched lines 54' and which are formed in the outer side wall panel 10 are straight, as in FIG. 1 (the perforated tear lines 46). Since pieces of material are left owing to the outward turn of the punched lines 54' from the spout, the tightness at the inner end of the spout is improved, both in the unopened package and in the opened and reclosed package. Thus, the pieces of material 64 will be deformed and pressed against the outer side wall panel edges that are formed by the perforated tear lines 46, resulting in an especially strong engagement at precisely the transition between these lines and the fold line 44 (see FIG. 1).

FIG. 4 also illustrates how the spout function may be further improved by pre-folding the inner side wall panel 10. It may thus be advantageous for some types of package materials to pre-fold the spout, before gluing the blank to a sleeve, along the fold lines 51 between the spout bottom 43 and the spout side walls 53, and then flatten the blank when glued. This considerably facilitates pulling out the spout. In the case of pre-folding, the entire inner side wall panel 10 is preferably provided with fold lines 66 in the extension of the lines 51. If these are inclined relative to one another, the fold lines 66 may be in the form of two lines laterally offset in relation to one another and provided above and below the fold lines 51.

Naturally, the package and the blank may be modified within the scope of the invention. Thus, the adhesive areas 61 and 62 can be broader or be designed as a single broad area covering the entire side wall panel 10. In the embodiment shown, the adhesive area 63 extends over the inner layer 43 of the channel bottom as well as the outward parts of the side wall panel 10. However, the adhesive area 63 may be shortened, so as to cover only the inner layer 43. Alternatively, adhesive can be applied to the inside of the outer side wall panel 14, should this be advantageous in view of the equipment used for erecting the package. Further, the side wall panel 10 may be shorter and extend to approximately half the height of the blank. If so, part of the side wall panel 10 closest to the fold line 15 has to be left in the form of an adhesive bonding flap of roughly the same width as the flap 30. By this design, the cardboard material or similar material is better utilised if successive blanks are swung half a turn in relation to one another.

In the embodiments shown, the spout 40 takes up most of the width of the inner side wall panel 10. Preferably, the spout is so designed that there is room for the adhesive areas 61, 62 on both sides of the spout areas 43, 53, i.e. between the spout side walls 53 and the adjoining edges of the inner side wall panel 10.

In the embodiments shown, the spout 40 tapers from the inner end (the fold lines 44, 45) to the outer end (the punched line 52 and the perforated line 47). As a result, the spout side walls are inclined towards one another. Within the scope of the invention, the spout may also have the same width from the inner end to the outer end or be broader at the outer end than at the inner end. In the latter case, the side walls 53 will diverge from one another.

We claim:

1. A package constructed of cardboard material, adapted to contain free-flowing pulverulent or granular goods and comprising tightly interconnected bottom, lid and side walls, one of said side walls being at least partially double-walled, including inner and outer side wall panels which are adhesively bonded together in overlapping fashion and have a pouring spout device formed from the cardboard of said inner and outer side walls panels, said pouring spout device comprising a channel bottom and channel side walls extending from the opposite side edges of said channel bottom, said channel side walls being free of adhesive bond to juxtaposed parts of the outer side wall panel, said channel bottom being formed of an outer layer and an inner layer, said outer layer channel bottom being disposed in the outer side wall panel and being delimited from the remainder of the outer side wall panel by a fold line intended to serve as a hinge and situated at an inner end of said channel bottom, and by perforated tear lines extending from the ends of said fold line to an outer end of the channel bottom where they are interconnected by a transverse perforated tear line, said inner layer being disposed in the inner side wall panel and being delimited, at the inner end of the channel bottom, from the remainder of the inner side wall panel by a fold line intended to serve as a hinge and situated in the erected package approximately opposite to the corresponding fold line in the outer side wall panel, and, said channel side walls are delineated at the outer end of the channel bottom, from the remainder of the inner side wall panel by a punched line, said inner layer being connected to said channel side walls by fold and punched lines which extend from ends of said fold line situated at the inner end of the channel bottom, to the ends of said punched line situated at the outer end of the channel bottom, said channel side walls being delimited from the surrounding parts of the inner side wall panel by arcuate punched lines, said arcuate punched lines extending from the ends of said punched line situated at the outer end of said channel bottom and merging into hook-forming punched lines which in turn merge into substantially straight punched lines extending substantially to the ends of said fold line situated at the inner end of said channel bottom, characterized in that a tear flap is formed in the outer side wall panel between said transverse perforated tear line delimiting the outer end of the pouring spout device, and a corner edge of said outer side wall panel spaced therefrom, said tear flap being delimiting, by a punched line at said edge and by perforated tear lines extending between said punched line and the ends of said transverse perforated tear line situated at the outer end of the channel bottom; that the inner side wall panel is provided with short punched lines which start from the transition between said punched line situated at the corner end of the channel bottom, and the arcuate punched lines at the outer end of the channel side walls, and extend outwards in relation to the outer end of the channel bottom; that said arcuate punched lines are so designed that the outer end ends delimited thereby project, when the spout is opened, into said short punched lines for positively guiding the channel side walls when opening and closing the spout.

2. A package as claimed in claim 1, characterized in that the tear flap extends a short distance beyond said edge of the outer side wall panel and into an adjoining lid panel with a weak adhesive bond between said inner and outer side wall panels within the area delimited by said tear flap.

3. A package as claimed in claim 1 or 2, characterized in that the channel bottom of the pouring spout device is broader at the inner end than at the outer end.

4. A package as claimed in claim 1 or 2 characterized in that the perforated tear lines of said tear flap are zip-type lines.

5. A package as claimed in claims 1 or 2, characterized in that there are provided, at least outwardly of the arcuate punched lines of the channel side walls respective to the inner side wall panel, holes which are punched in the inner side wall panel and which terminate at a distance from said hook-forming punched lines and are designed to leave space for the resulting hooks during the initial stage of the opening of the pouring spout device.

6. A package as claimed in claim 1 or 2, characterized in that said outer layer of said channel bottom extends farther out from said fold line serving as a hinge for the pouring spout device, than does said inner layer of said channel bottom in order to increase the tightness of the opened package.

7. A package as claimed in claim 1 or 2, characterized in that said fold line provided in the inner side wall panel at the inner end of the channel bottom is extended outwards in both directions by a punched extension line, and that said punched lines delimiting the channel side walls and extending from the hook-forming punched lines substantially to the ends of said fold line situated at the channel bottom, are curved outwards from one another close to these ends and extend up to said punched extension line.

8. A package as claimed in claim 1 or 2, characterized in that the inner side wall panel is pre-folded at least along the fold and punched lines between said channel bottom and said channel side walls and preferably also in the areas outwardly thereof and in their extension.

9. A cardboard blank for moving a package comprising interconnected bottom, lid and side walls panels and bonding flaps for adhesively bonding together the blank to form a package when erected, one bonding flap intended to be adhesively bonded to the inside of a side wall panel being so designed that the corresponding side wall in the erected package is at least partially double-walled, including inner and outer side wall panels provided with a pouring spout device formed from the material of these side wall panels and comprising a channel bottom and channel side walls extending from opposite side edges of said channel bottom, said channel bottom being formed of an outer layer and an inner layer, said outer layer being disposed in the outer side wall panel and delimited from the remainder thereof by a fold line intended to serve as a hinge and situated at the inner end of the channel bottom, and by perforated tear lines extending from the ends of said fold line to the outer end of the channel bottom where they are interconnected by a perforated transverse tear line, said inner layer being disposed in the inner side wall panel and being delimited, at the inner end of the channel bottom, from the remainder of the inner side wall panel by a fold line intended to serve as a hinge and situated in the erected package approximately opposite to the corresponding fold line in the outer side wall panel, and, at the outer end of the channel bottom, from the remainder of the inner side wall panel by a punched line, said inner layer 10 being connected to said channel side walls by fold and punched lines which extend from the ends of said fold line situated at the inner end of the channel bottom, to the ends of the punched line situated at the outer end of the channel bottom, said channel side walls being delimited from the surrounding parts of the inner side wall panel by arcuate punched lines, said arcuate punched lines extending from the ends of said punched line situated at the outer end of said channel bottom and merging into hook-forming punched lines which in turn merge into substantially straight punched lines extending substantially to the ends of said fold line situated at the inner end of the channel bottom, characterized in that a tear flap is formed in the outer side wall panel between said transverse perforated tear line delimiting the outer end of the spout, and an edge of said outer side wall panel spaced therefrom, said tear flap being delimited by a punched line at said edge and by perforated tear lines extending between said punched line and the ends of said transverse perforated tear line situated at the outer end of said channel bottom; that the inner side wall panel is provided with short punched lines which start from the transition between said punched line situated at the outer end of the channel bottom, and the arcuate punched lines at the outer end of the channel side walls, and extend outwards in relation to the outer end of the channel bottom; that said arcuate punched lines are so designed that the outer end edges delimited thereby project, when the spout is opened, into said short punched lines for positively guiding the channel side walls when opening and closing the spout.

10. A blank as claimed in claim 9, characterized in that the tear flap extends a short distance beyond said edge of the outer side wall panel and into the adjoining lid panel.

11. A blank as claimed in claim 9 or 10, characterized in that the channel bottom of the spout is broader at the inner end than at the outer end.

12. A blank as claimed in claim 9 or 10, characterized in that the perforated tear lines 50 of said tear flap are zip-type lines.

13. A blank as claimed in claims 9 or 10, characterized in that there are provided, at least outwardly of the arcuate punched lines of the channel side walls, holes which are punched in the inner side wall panel and which terminate at a distance form said hook-forming punched lines and are designed to leave space for the resulting hooks during the initial stage of the opening of the spout.

14. A blank as claimed in claim claims 9 or 10, characterized in that said fold line 45 provided in the inner side wall panel at the inner end of the channel bottom is extended outwards in both directions by a punched extension line, and that said punched lines delimiting the channel side walls and extending from the hook-forming punched lines substantially to the ends of said fold line situated at the channel bottom, are curved outwards from one another close to these ends and extend up to said punched extension line.

15. A blank as claimed in claims 9 or 10, characterized in that said inner side wall panel is pre-folded at least along the fold lines between said channel bottom and said channel side walls.

16. A package constructed of cardboard and adapted to contain free-flowing pulverulent or granular goods and comprising tightly interconnected bottom, lid and side walls, one of said side walls being at least partially double-walled, including inner and outer side wall panels which are adhesively bonded together in overlapping fashion and have a pouring spout device formed from the cardboard of said inner and outer side wall panels, said pouring spout device comprising a channel bottom and channel side walls extending from opposite side edges of said channel bottom, said channel side walls being free of adhesive bond to juxtaposed parts of the outer side wall panel, said channel bottom being formed of an outer layer and an inner layer, said outer layer of the channel bottom being disposed in the outer side wall panel and being delimited from the remainder of the outer side wall panel by a fold line intended to serve as a hinge and situated at an inner end of the channel bottom, and by perforated tear lines extending from the ends of a fold line to an outer end of the channel bottom where they are interconnected by a transverse perforated tear line, said channel bottom inner layer being disposed in the inner side wall panel and being delimited, at the inner end of the channel bottom, from the remainder of the inner side wall panel by a fold line intended to serve as a hinge and situated in the erected package approximately opposite to the corresponding fold line in the outer side wall panel, and, said channel side walls are delimited at the outer end of the channel bottom from the remainder of the inner side wall panel by a punched line, said inner layer being connected to said channel side walls by fold and punched lines which extend from ends of said fold line situated at the inner end of the channel bottom, to the ends of said punched line situated at the outer end of the channel bottom, said channel side walls being delimited from the surrounding parts of the inner side wall panel by arcuate punched lines, said arcuate punched lines extending from the ends of said punched line situated at the outer end of said channel bottom and merging into hook-forming punched lines which in turn merge into substantially straight punched lines extending substantially to the ends of said fold line situated at the inner end of said channel bottom, characterized in that a tear flap is formed in the outer side wall panel between said transverse perforated tear line delimiting the outer end of the pouring spout device, and a corner edge of said outer side wall panel spaced therefrom, said tear flap being delimited by a punched line at said edge and by perforated tear lines extending between said punched line and ends of said transverse perforated tear line situated at the outer end of said outer layer channel bottom; that the inner side wall panel is provided with short punched lines which start from the transition between said punched line situated at the outer end of the channel bottom, and the arcuate punched lines at the outer end of the channel side walls, and extend outwards in relation to the outer end of the channel bottom; that said arcuate punched lines are so designed that the outer end edges delimited thereby project, when the spout is opened, into said short punched lines for positively guiding the channel side walls when opening and closing the spout; and the method further characterized in that the tear flap extends a short distance beyond said edge of the outer side wall panel and into an adjoining lid panel.

17. A package as claimed in claim 16, characterized in that the channel bottom of the pouring spout device is broader at the inner end of said spout than at the outer end and that said inner and outer side wall panels are bonded together with a weak adhesive within the area delimited by said tear flap.

18. A package as claimed in claim 16 or 17, characterized in that the perforated tear lines of said tear flap are zip-type lines.

19. A package as claimed in claim 16 or 17, characterized in that there are provided, at least outwardly of the arcuate punched lines of the channel side walls, holes which are punched in the inner side wall panel and which end at a distance from said hook-forming punched lines and are designed to leave space for the resulting hooks during the initial stage of the opening of the pouring spout device.

20. A package as claimed in claim 16 or 17, characterized in that said outer layer of said channel bottom extends further out from said fold line serving as a hinge for the pouring spout device, than does said inner layer of said channel bottom in order to increase the tightness of the opened package.

21. A package as claimed in claim 16 or 17, characterized in that said fold line provided in the inner side wall panel at the inner end of the channel bottom is extended outwards in both directions by a punched extension line, and that said punched lines delimiting the channel side walls and extending from the hook-forming punched lines substantially to the ends of said fold line situated at the channel bottom, are curved outwards from one another close to these ends and extend up to said punched extension line.

22. A package as claimed in claim 16 or 17, characterized in that the inner side wall panel is pre-folded at least along the fold and punched lines between said channel bottom and said channel side walls and preferably also in the areas outwardly thereof and in their extension.

23. A package constructed of cardboard adapted to contain free-flowing pulverulent or granular goods and comprising tightly interconnected bottom, lid and sidewalls, one of said side walls being at least partially double-walled, including inner and outer side wall panels which are adhesively bonded together in overlapping fashion and have a pouring spout device formed from the cardboard of said inner and outer side wall panels, said pouring spout device comprising a channel bottom and channel side walls extending from opposite side edges of said channel bottom, said channel side walls being free of adhesive bond to juxtaposed parts of the outer side wall panel, said channel bottom being formed of an outer layer and an inner layer, said outer layer of the channel bottom being disposed in the outer side wall panel and being delimited from the remainder of the outer side all panel by a fold line intended to serve as a hinge and situated at an inner end of the channel bottom, and by perforated tear lines extending from the ends of said fold line to an outer end of the channel bottom where they are interconnected by a transverse perforated tear line, said channel bottom inner layer being disposed in the inner side wall panel and being delimited, at the inner end of the channel bottom, from the remainder of the inner side wall panel by a fold line intended to serve as a hinge and situated in the erected package approximately opposite to the corresponding fold line in the outer side wall panel, and, said channel side walls are delimited at the outer end of the channel bottom from the remainder of the inner side wall panel by a punched line, said inner layer being connected to said channel side walls by fold and punched lines which extend from ends of said fold line situated at the inner end of the channel bottom, to the ends of said punched line situated at the outer end of the channel bottom, said channel side walls being delimited from the surrounding parts of the inner side wall panels by arcuate punched lines, said arcuate punched lines extending from the ends of said punched lines situated at the outer end of said channel bottom and merging into hook-forming punched lines which in turn merge into substantially straight punched lines extending substantially to the ends of said fold line situated at the inner end of said channel bottom, characterized in that a tear flap is formed in the outer side wall panel between said transverse perforated tear line delimiting the outer end of the pouring spout device, and a corner edge of said outer side wall panel spaced therefrom, said tear flap being delimited by a punched line at said edge and by perforated tear lines extending between said edge punched line and ends of said transverse perforated tear line situated at the outer end of the channel bottom; that the inner side wall panel is provided with short punched lines which start from the transition between said punched line situated at the outer end of the channel bottom, and the arcuate punched lines at the outer end of the channel side walls, and extend outwards in relation to the outer end of the channel bottom; that said arcuate punched lines are so designed that the outer end edges delimited thereby project, when the spout is opened, into said short punched lines for positively guiding the channel side walls when opening and closing the spout; the package further characterized in that the tear flap extends a short distance beyond said edge of the outer side wall panel and into an adjoining lid panel; and the package further characterized in that the channel bottom of the pouring spout device is broader at the inner end than at the outer end.

24. A package as claimed in claim 23, characterized in that the perforated tear lines of said tear flap are zip-type lines and that said inner and outer side wall panels are bonded together with a weak adhesive within the area delimited by said tear flap.

25. A package as claimed in claim 23 or 24, characterized in that there are provided, at least outwardly of the arcuate punched lines of the channel side walls, holes which are punched in the inner side wall panel and which terminate at a distance from said hook-forming punched lines and are designed to leave space for the resulting hooks during the initial stage of the opening of the pouring spout device.

26. A package as claimed in claim 23 or 24, characterized in that said outer layer of said channel bottom extends further out from said fold line serving as a hinge for the pouring spout device, than does said inner layer of said channel bottom in order to increase the tightness of the opened package.

27. A package as claimed in claim 23 or 24, characterized that said fold line provided in the inner side wall panel at the inner end of the channel bottom is extended outwards in both directions by a punched extension line, and that said punched lines delimiting the channel side walls and extending from the hook-forming punched lines substantially to the ends of said fold line situated at the channel bottom, are curved outwards from one another close to these ends and extend up to said punched extension line.

28. A package as claimed in claim 23 or 24, characterized in that the inner side wall panel is pre-folded at least along the fold and punched lines between said channel bottom and said channel side walls and preferably also in the areas outwardly thereof and in their extension.

29. A package constructed of cardboard adapted to contain free-flowing pulverulent or granular goods and comprising tightly interconnected bottom, lid and side walls, one of said side walls being at least partially double-walled, including inner and outer side wall panels which are adhesively bonded together in overlapping fashion and have a pouring spout device formed from the cardboard of said inner and outer side wall panels, said pouring spout device comprising a channel bottom and channel side walls extending from opposite side edges of said channel bottom, said channel side walls being free of adhesive bond to juxtaposed parts of the outer side wall panel, said channel bottom being formed of an outer layer and an inner layer, said outer layer of the channel bottom being disposed in the outer side wall panel and being delimited from the remainder of the outer side wall panel by a fold line intended to serve as a hinge and situated at an inner end of the channel bottom, and by perforated tear lines extending from the ends of said fold line to an outer end of the channel bottom where they are interconnected by a transverse perforated tear line, said inner layer being disposed in the inner side wall panel and being delimited, at the inner end of the channel bottom from the remainder of the inner side wall panel by a fold line intended to serve as a hinge and situated in the erected package approximately opposite to the corresponding fold line in the outer side wall panel, and, said channel side walls are delimited at the outer end of the channel bottom, from the remainder of the inner side wall panel by a punched line, said inner layer being connected to said channel side walls by fold and punched lines which extend from ends of said fold line situated at the inner end of the channel bottom, to the ends of said punched line situated at the outer end of the channel bottom, said channel side walls being delimited from the surrounding parts of the inner side wall panel by arcuate punched lines, said arcuate punched lines extending from the ends of said punched line situated at the outer end of said channel bottom and merging into hook-forming punched lines which in turn merge into substantially straight punched lines extending substantially to the ends of said fold line situated at the inner end of said channel bottom, characterized in that a tear flap is formed in the outer side wall panel between said transverse perforated tear line delimiting the outer end of the pouring spout device, and an edge of said outer side wall panel spaced therefrom, said tear flap being delimited by a punched line at said edge and by perforated tear lines extending between said punched line and ends of said transverse perforated tear line situated at the outer end of the channel bottom; that the inner side wall panel is provided with short punched lines which start from the transition between said punched line situated at the outer end of the channel bottom, and the arcuate punched lines at the outer end of the channel side walls, and extend outwards in relation to the outer end of the channel bottom; that said arcuate punched lines are so designed that the outer end edges delimited thereby project, when the spout is opened, into said short punched lines for positively guiding the channel side walls when opening end closing the spout; the package further characterized in that the tear flap extends a short distance beyond said edge of the outer side wall panel and into an adjoining lid panel; the package further characterized in that the channel bottom of the pouring spout device is broader at the inner end than at the outer end; and the package further characterized i n that the perforated tear lines of said tear flap are zip-type lines.

30. A package as claimed in claim 29, characterized in that there are provided, at least outwardly of the arcuate punched lines of the channel side walls, holes which are punched in the inner side wall panel and which terminate at a distance from said hook-forming punched lines and are designed to leave space for the resulting hooks during the initial stage of the opening of the pouring spout device and that said inner and outer side wall panels are bonded together with a weak adhesive within the area delimited by said tear flap.

31. A package as claimed in claim 29 or 30, characterized in that said outer layer of said channel bottom extends further out from said fold line serving as a hinge for the pouring spout device, than does said inner layer of said channel bottom in order to increase the tightness of the opened package.

32. A package as claimed in claim 29 or 30, characterized in that said fold line provided in the inner side wall panel at the inner end of the channel bottom is extended outwards in both directions by a punched extension line, and that said punched lines delimiting the channel side walls and extending from the hook-forming punched lines substantially to the ends of said fold line situated at the channel bottom, are curved outwards from one another close to these ends and extend up to these punched extension line.

33. A package as claimed in claim 29 or 30, characterized in that the inner side wall panel is pre-folded at least along the fold and punched lines between said channel bottom and said channel side walls and also in the areas outwardly thereof and in their extension.

34. A package constructed of cardboard adapted to contain free-flowing pulverulent or granular goods and comprising tightly interconnected bottom, lid and side walls, one of said side walls being at least partially double-walled, including inner and outer side wall panels which are adhesively bonded together in overlapping fashion and have a pouring spout device formed from the cardboard of said inner and outer side wall panels, said pouring spout device comprising a channel bottom and channel side walls extending from opposite side edges of said channel bottom and being free of adhesive bond to juxtaposed parts of the outer side wall panel, said channel bottom being formed of an outer layer and an inner layer, said outer layer of the channel bottom being disposed in the outer side wall panel and being delimited from the remainder of the outer side wall panel by a fold line intended to serve as a hinge and situated at an inner end of the channel bottom, and by perforated tear lines extending from the ends of said fold line to an outer end of the channel bottom where they are interconnected by a transverse perforated tear line, said inner layer being disposed in the inner side wall panel and being delimited, at the inner end of the channel bottom from the remainder of the inner side wall panel by a fold line intended to serve as a hinge and situated in the erected package approximately opposite to the corresponding fold line in the outer side wall panel, and, said channel side walls are delimited at the outer end of the channel bottom, from the remainder of the inner side wall panel by a punched line, said inner layer being connected to said channel side walls by fold and punched lines which extend from ends of said fold line situated at the inner end of the channel bottom, to the ends of said punched line situated at the outer end of the channel bottom, said channel side walls being delimited from the surrounding parts of the inner side wall panel by arcuate punched lines, said arcuate punched lines extending from the ends of said punched line situated at the outer end of said channel bottom and merging into hook-forming punched lines which in turn merge into substantially straight punched lines extending substantially to the ends of said fold line situated at the inner end of said channel bottom, characterized in that a tear flap is formed in the outer side wall panel between said transverse perforated tear line delimiting the outer end of the pouring spout device, and a corner edge of said outer side wall panel spaced therefrom, said tear flap being delimited by a punched line at said edge and by perforated tear lines extending between said punched line and ends of said transverse perforated tear line situated at the outer end of the channel bottom; that the inner side wall panel is provided with short punched lines which start from the transition between said punched line situated at the outer end of the channel bottom, and the arcuate punched lines at the outer end of the channel side walls, and extend outwards in relation to the outer end of the channel bottom; that said arcuate punched lines are so designed that the outer end edges delimited thereby project, when the spout is opened, into said short punched lines for positively guiding the channel side walls when opening and closing the spout; the package further characterized in that the tear flap extends a short distance beyond said edge of the outer side wall panel and into an adjoining lid panel; the package further characterized in that the channel bottom of the pouring spout device is broader at the inner end than at the outer end; the package further characterized in that the perforated tear lines of said tear flap are zip-type lines; and the method further characterized in that there are provided, at least outwardly of the arcuate punched lines of the channel side walls, holes which are punched in the inner side wall panel and which terminate at a distance from said hook-forming punched lines and are designed to leave space for the resulting hooks during the initial stage of the opening of the pouring spout device.

35. A package as claimed in claim 34, characterized in that said outer layer of said channel bottom extends further out from said fold line serving as a hinge for the pouring spout device, than does said inner layer of said channel bottom in order to increase the tightness of the opened package and that said inner and outer side wall panels are bonded together with a weak adhesive within the area delimited by said tear flap.

36. A package as claimed in claim 34 or 35, characterized in that said fold line provided in the inner side wall panel at the inner end of the channel bottom is extended outwards in both directions by a punched extension line, and that said punched lines delimiting the channel side walls and extending from the hook-forming punched lines substantially to the ends of said fold line situated at the channel bottom, are curved outwards from one another close to these ends and extend up to said punched extension line.

37. A package as claimed in claim 34 or 35, characterized in that the inner side wall panel is pre-folded at least along the fold and punched lines between said channel bottom and said channel side walls and preferably also in the areas outwardly thereof and in their extension.

38. A package constructed of cardboard adapted to contain free-flowing pulverulent or granular goods and comprising tightly interconnected bottom, lid and side walls, one of said side walls being a least partially double-walled, including inner and outer side wall panels which are adhesively bonded together in overlapping fashion and have a pouring spout device formed from the cardboard of said inner and outer side wall panels, said pouring spout device comprising a channel bottom and channel side walls extending from opposite side edges of said channel bottom, said channel side walls being free of adhesive bond to juxtaposed parts of the outer side wall panel, said channel bottom being formed of an outer layer and an inner layer, said outer layer of the channel bottom being disposed in the outer side all panel and being delimited from the remainder of the outer side wall panel by a fold line intended to serve as a hinge and situated at an inner end of the channel bottom, and by perforated tear lines extending from the ends of said fold line to an outer end of the channel bottom where they are interconnected by a transverse perforated tear line, said channel bottom inner layer being disposed in the inner side wall panel and being delimited, at the inner end of the channel bottom from the remainder of the inner side wall panel by a fold line intended to serve as a hinge and situated in the erected package approximately opposite to the corresponding fold line in the outer side wall panel, and, said channel side walls are delimited at the outer end of the channel bottom from the remainder of the inner side wall panel by a punched line, said inner layer being connected to said channel side walls by fold and punched lines which extend from ends of said fold line situated at the inner end of the channel bottom, to the ends of said punched line situated at the outer end of the channel bottom, said channel side walls being delimited from the surrounding parts of the inner side wall panel by arcuate punched lines, said arcuate punched lines extending from the ends of said punched line situated at the outer end of said channel bottom and merging into hook-forming punched lines which in turn merge into substantially straight punched lines extending substantially to the ends of said fold line situated at the inner end of said channel bottom, characterized in that a tear flap is formed in the outer side wall panel between said transverse perforated tear line delimiting the outer end of the pouring spout device, and an edge of said outer side wall panel spaced therefrom, said tear flap being delimited by a punched line at said edge and by perforated tear lines extending between said punched line and ends of said transverse perforated tear line situated at the outer end of the channel bottom; that the inner side wall panel is provided with short punched lines which start from the transition between said punched line situated at the outer end of the channel bottom, and the arcuate punched lines at the outer end of the channel side walls, and extend outwards in relation to the outer end of the channel bottom; that said arcuate punched lines are so designed that the outer end edges delimited thereby project, when the spout is opened, into said short punched lines for positively guiding the channel side walls when opening and closing the spout; the package further characterized in that the tear flap extends a short distance beyond said edge of the outer side wall panel and into an adjoining lid panel; the package further characterized in that the channel bottom of the pouring spout device is broader at the inner end than at the outer end; the package further characterized in that the perforated tear lines of said tear flap are zip-type lines; the package further characterized in that there are provided, at least outwardly of the arcuate punched lines of the channel side walls, holes which are punched in the inner side wall panel and which terminate at a distance from said hook-forming punched lines and are designed to leave space for the resulting hooks during the initial stage of the opening of the pouring spout device; and the package further characterized in that said outer layer of said channel bottom extends further out from said fold line serving as a hinge for the pouring spout device, than does said inner layer of said channel bottom in order to increase the tightness of the opened package.

39. A package as claimed in claim 38, characterized in that said fold line provided in the inner side wall panel at the inner end of the channel bottom is extended outwards in both directions by a punched extension line, and that said punched lines delimiting the channel side walls and extending from the hook-forming punched lines substantially to the ends of said fold line situated at the channel bottom, are curved outwards from one another close to these ends and extend up to said punched extension line and that said inner and outer side wall panels are bonded together with a weak adhesive within the area delimited by said tear flap.

40. A package as claimed in claim 38 or 39, characterized in that the inner side wall panel is pre-folded at least along the fold and punched lines between said channel bottom and said channel side walls and preferably also in the areas outwardly thereof and in their extension.

* * * * *